United States Patent [19]

Helmke et al.

[11] Patent Number: 4,962,556

[45] Date of Patent: Oct. 16, 1990

[54] LIGHTWEIGHT, COLLAPSIBLE BRIDGE MODULE, AND SYSTEM WITH DEPLOYMENT AND RETRIEVAL TRAILER

[75] Inventors: Richard W. Helmke, Stafford; David C. Smith, Alexandria; Mark P. Levine, Woodbridge, all of Va.

[73] Assignee: The United States of America as represented by the Secretary of the Army, Washington, D.C.

[21] Appl. No.: 318,213

[22] Filed: Mar. 2, 1989

[51] Int. Cl.[5] ..... E01D 15/12

[52] U.S. Cl. ..... 14/2.4; 14/5

[58] Field of Search ..... 14/1, 2.4, 2.6, 2.7, 14/5, 6, 69.5; 404/35, 36

[56] References Cited

U.S. PATENT DOCUMENTS

| | | | |
|---|---|---|---|
| 3,105,251 | 10/1963 | Stevens, Jr. et al. | 14/2.6 |
| 4,521,932 | 6/1985 | Parramore | 14/2.4 |
| 4,635,311 | 1/1987 | Helmke | 14/2.4 |

FOREIGN PATENT DOCUMENTS

| | | | |
|---|---|---|---|
| 1938940 | 2/1971 | Fed. Rep. of Germany | 14/2.4 |

OTHER PUBLICATIONS

Popular Mechanics, "Portable One Track Bridge Carried by Soldier", Feb., 1942, p. 54.

*Primary Examiner*—Jerome W. Massie, IV

*Assistant Examiner*—Matthew Smith

*Attorney, Agent, or Firm*—Anthony T. Lane; Charles D. Miller

[57] ABSTRACT

A modular lightweight bridge comprises a pair of tubular truss formed spans, each of which include a plurality of modules hinged to one another at locations on the bottom of the bridge for folding the bridge for transport prior to deployment of the bridge. Each span has a unique high strength fabric deck or roadway surface tensioned across the upper side of the truss chord members. The bridge is uniquely captively mounted on a trailer by rollers for transporting the bridge when it is in its folded mode. When the bridge is to be deployed, each span is unfolded by pivoting the modules with respect to one another about vertical axes so that the spans expand longitudinally with respect to the trailer. The spans are then pivoted 90° downwardly about longitudinally extending horizontal axes and the bridge rolled rearwardly from the trailer over the gap to be spanned. Due to the unique captive roller interconnection between the bridge assembly and its transport-deployment trailer, the trailer can thereafter be stored beneath the deployed bridge hanging down into the gully or gap. When a decision is made to remove the bridge, the trailer can be towed from either side back over the bank of the gap and the bridge refolded for mounting on and transport by the trailer.

16 Claims, 8 Drawing Sheets

LIGHTWEIGHT, COLLAPSIBLE BRIDGE MODULE, AND SYSTEM WITH DEPLOYMENT AND RETRIEVAL TRAILER

GOVERNMENT INTEREST

The invention described herein may be manufactured, used and licensed by or for the government for governmental purposes without payment to us of any royalties thereon.

BACKGROUND OF THE INVENTION

1. Field of the Invention

The present invention relates broadly to portable bridges, and more particularly to portable bridges suitable for military purposes, employed for crossing wet and dry gaps. More specifically, the instant invention relates to a modular lightweight bridge assembly which is portable and will support lightweight vehicles such as small trucks, jeeps and the like, as well as serving as a foot bridge.

2. Background of the Invention

For military purposes, and perhaps for civilian use in remote areas and emergency situations, there is a need for a lightweight, manually deployable bridge which can be towed by lightweight vehicles such as those used with light military forces. Specifically for military deployment, there is a need for a bridge which requires no auxiliary power system for its launch and recovery, and which may be deployed either by the towing vehicle or manually by ordinary troops with minimal training. One difficulty which needs to be addressed with available bridges is that the bridges have both high profile and audible signatures, which makes the bridges easy to identify as targets.

3. Prior Patent Literature

The patent literature includes a number of examples of bridges carried by vehicles. However, in most cases, the bridges are heavy structures for supporting trucks, tanks and the like and are not towable by lightweight vehicles, nor are they manually deployable with ease. Exemplary of such bridges are the bridges disclosed in U.S. Pat. Nos. 4,635,311; 4,319,375; 2,556,175; 2,687,225; and 3,105,251.

The patent literature also includes relatively lightweight structures such as those disclosed of U.S. Pat. Nos. 2,704,989; 2,977,612; and 4,521,932. The bridge disclosed in U.S. Pat. Nos. 2,704,989 is a floating bridge exemplified in one embodiment by an omnibus structure which can also serve, among other things, as an assault vehicle, ambulance and troop carrier. U.S. Pat. No. 2,977,612 discloses a portable floating bridge which is made up of modular sections of rather robust construction, not necessarily suitable for manual deployment nor towing by light vehicles. U.S. Pat. No. 4,521,932 discloses a bridge in which lightweight construction is employed, but the bridge still needs a special, rather large vehicle, including a derrick for achieving erection.

Clearly, prior art bridge devices do not fill the need for a low-profile, lightweight, collapsible modular bridge which may be transported by a light vehicle, such as a light infantry jeep. None of the bridges disclosed in the aforementioned prior art patents can be conveniently parachuted from an airplane or conveniently delivered by helicopter.

BRIEF SUMMARY OF THE INVENTION

It is an object of the instant invention to provide a lightweight, collapsible bridge module and trailer deployment system which can be conveniently transported by a light vehicle and, upon arriving at the site, can be either vehicularly or manually deployed.

A lightweight modular bridge configured in accordance with the instant invention comprises at least one span uniquely and novelly featuring at least semiflexible deck component means, and more preferably, comprising a high strength tensioned fabric deck membrane for supporting traffic, and a frame for supporting the novel fabric deck means and for delineating a bottom surface area. Each span is divided into a plurality of modules or sections which are hinged together by pinned link, dual-center hinges disposed along the bottom surface area.

In accordance with the preferred embodiment, each span embodies generally rigid girders or trusses disposed such that the span frame comprises a pair of horizontally extending upper truss chords and a pair of horizontal lower truss chords which are held together in a box-like configuration by arrays of vertically extending and horizontally extending braces, with the novel fabric deck component extending between and being secured to the pair of upper truss chords.

Preferably, the deck component is of a durable, high strength fabric material which is secured continuously along the periphery thereof to the upper truss chords.

Each of the span's sections or modules is hinged to an adjacent module by a pair of pinned link, dual-center hinges wherein spaced pairs of links pivotally interconnect opposed lower truss chords of adjacent modules in conjunction with intermeshed fixed gear members which are disposed between said links to help stabilize and guide the folding and unfolding of the respectively connected modules.

The modular bridge of the present invention includes support means which is preferably in the form of a transporting and deployment trailer in combination therewith which has rollers thereon for supporting the modular bridge spans when the bridge is in its folded mode and also during the initial deployment stage. Preferably, the roller means comprises pairs of opposed concave-convex rollers between which are received the inboard, lower truss chords of each center bay module, wherein the modules can be both rolled longitudinally with respect to the trailer when unfolded and fully 180° aligned for deployment of the bridge, and can be subsequently rolled back during retrievement and pivoted about the spans longitudinal axes of the inboard, lower truss chords to raise back the deck components into vertical disposition for side-by-side storage on and transport by the trailer. Because the bridge assembly is essentially captively mounted on the trailer by the aforementioned rollers engaging the inboard, lower truss chords, the roller-attached trailer remains attached to and is adapted to be subsequently supported by the bridge when the bridge is deployed over a gully or gap. By the unique arrangement allowing storing of the trailer in this manner, the trailer naturally positions the spans laterally with respect to one another to correspond to most vehicles' wheel track span, while the inboard, upper truss chords of the spans are held at the correct horizontal disposition and spacing by pivotally hinged tie-rod structural members extending therebetween.

Upon further study of the specification and appended claims, further objects and advantages of this invention will become apparent to those skilled in the art.

BRIEF DESCRIPTION OF THE DRAWINGS

Various other objects, features and attendant advantages of the present invention will be more fully appreciated as the same becomes better understood when considered in conjunction with the accompanying illustrative drawings in which like reference characters designate the same or similar parts throughout the several views, and wherein.

DETAILED DISCUSSION OF THE PREFERRED EMBODIMENT

Figure 1:
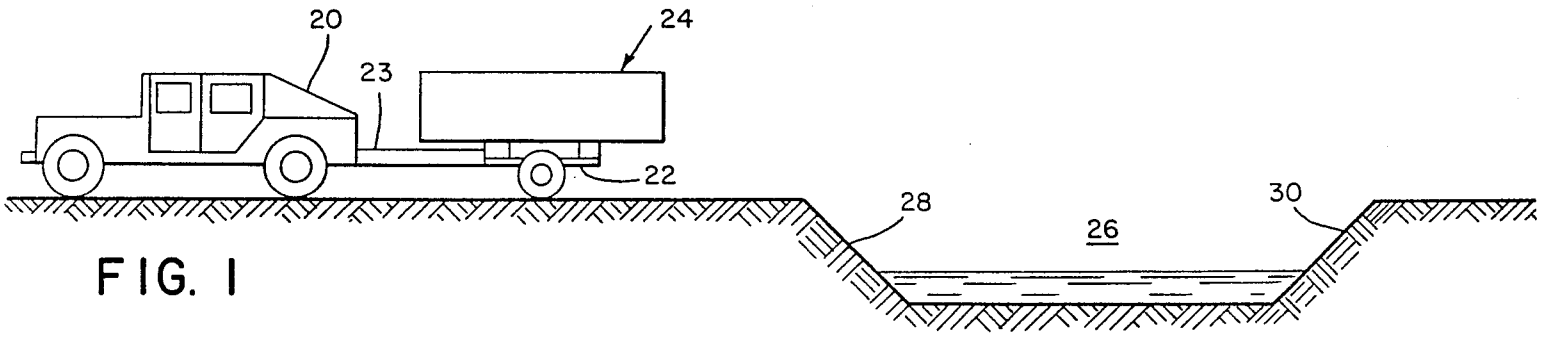
FIG. 1 is a side diagrammatical view showing a light vehicle towing a collapsed low profile, modular bridge configured in accordance with the principles of the instant invention.
Figure 2:
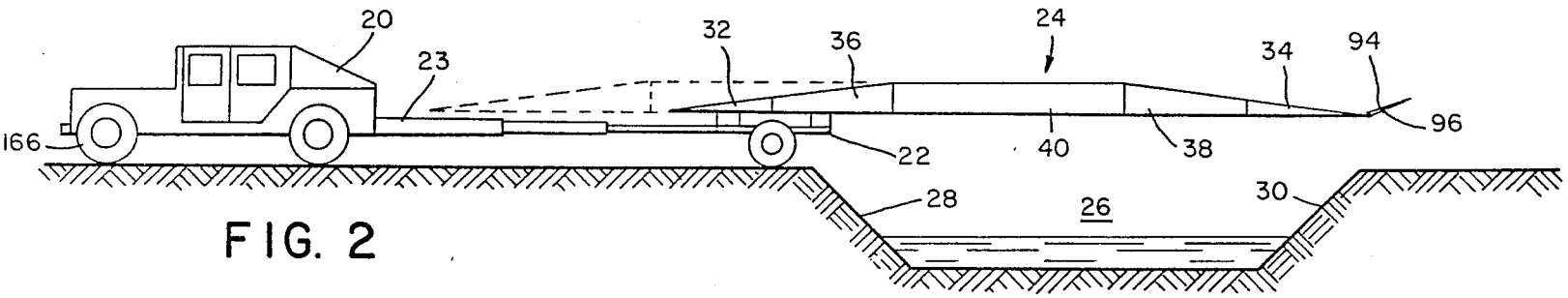
FIG. 2 is a view similar to FIG. 1 showing the bridge assembly after unfolding and being deployed over a gully or other depression by the vehicle.
Figure 3:
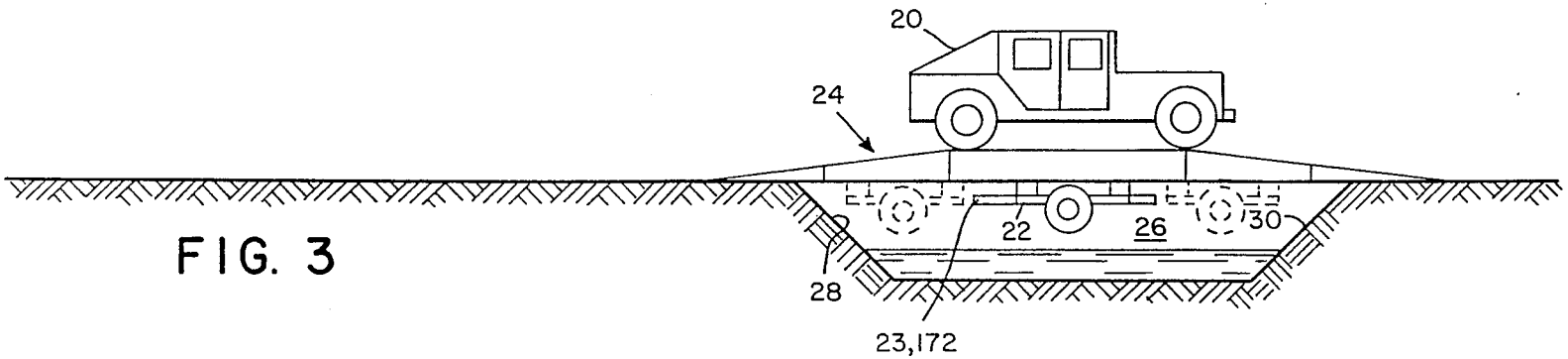
FIG. 3 is a view showing the bridge deployed, wherein the trailer used to transport the bridge stays attached to and is stored beneath the bridge for subsequent use, should it be desired to move the bridge to a different location.

Referring now to FIG. 1, there is shown a tow vehicle 20 such as a military High Mobility Multipurpose Vehicle (HMMV) used for towing a trailer 22 with removable and repositionable tow bar 23, and upon which trailer is mounted our modular bridge, designated generally by the numeral 24, configured in accordance with the principles of the instant invention. In the sequential illustration of FIGS. 1, 2, 3 and 4, the modular bridge 24 spans a gully 26 defined by a pair of opposed banks 28 and 30. In FIG. 2, the modular bridge 24 has been completely unfolded to extend longitudinally so as to span the gully 26. The unfolding can be better viewed in FIG. 4, and is accomplished by pivoting endmost ramp sections or modules 32 and 34 with respect to intermediate ramp sections or modules 36 and 38, which are in turn pivoted from central bay sections or modules 40 so as to become 180° aligned for each span while in the vertical folded position of FIG. 4. As is seen in FIGS. 2 and 5 (phantom portions)in contrast with FIG. 1, the modular bridge 24 has been further reoriented from a collapsed vertical orientation (FIG. 4) which it assumes while stored on the trailer 22, to a horizontal further unfolded orientation assumed for deployment over the gully 26.

The unfolded bridge 24 is preferably deployed over the gully by backing the trailer 22 to the bank 28 while the bridge is suspended at one end on the trailer, and allowing the trailer wheels to ride down the gully embankment until the bridge 24 becomes lowered in place. Due to the unique interconnected arrangement of the bridge module and support-launch trailer, to be more fully explained hereinafter, after the bridge is settled into the deployed position, the trailer 22 and the removably adjustable tow bar 23 are then stored in the gully 26 beneath the bridge 24.

Figure 14:
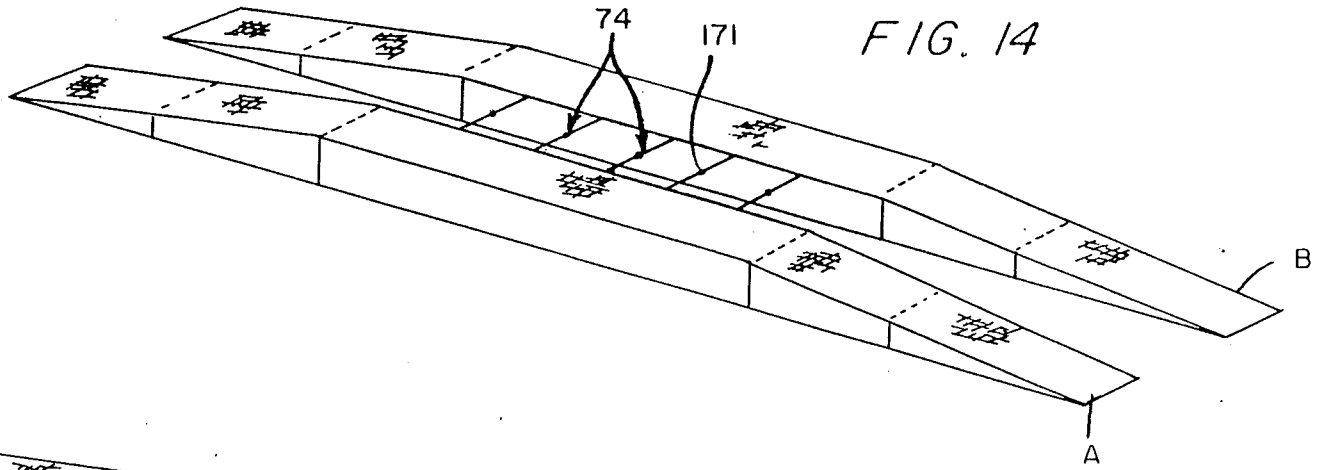
FIG. 14 is a diagrammatic perspective view of a pair of spans joined together in their center bay sections by a plurality of foldable tie-rod members, to form a deployed vehicular bridge.
Figure 15:
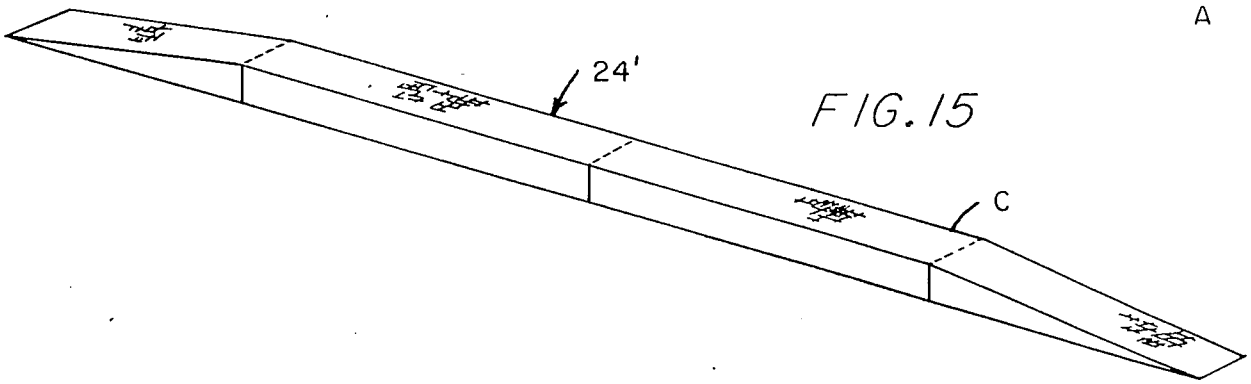
FIG. 15 is a perspective view of a modified single span suitable as a foot bridge.

When it is desired to move the bridge 24 for continued transport, it may be retrieved from either the bank 30 or the bank 28 by use of the tow bar 23 being suitably repositioned to the selected side and the trailer 22 is simply pulled up the selected bank. The bridge sections are refolded for storage on the trailer as shown in FIGS. 1 and 6 and can again be towed over land for redeployment somewhere else. As is seen in FIGS. 4 and 14, the bridge 24 preferably comprises two spans, A and B, in order to support pairs of wheels for vehicular traffic, or, as is seen in FIG. 15, the bridge may consist of a single span C which would be suitable as a foot bridge and/or for tandem 2 wheel cycles.

With the basic concepts as set forth in FIGS. 1–4 in mind, it is seen that a light 4-wheel vehicle and foot bridge 24 is provided which is of special interest for military applications wherein light divisions usually deployed by airborne units are provided with increased mobility. Depending on the number of modules utilized, the bridge 24 will have a length of between 12 to 23 meters for spanning gullies of various sizes. The bridge 24 is of special interest for low-intensity military conflicts and for emergency situations such as floods or earthquakes in which bridges have been destroyed. In addition, the modular bridges 24 are of interest or useful in remote areas having minimal road facilities and at construction sites where it is necessary to frequently span local gullies and gaps.

Figure 4:
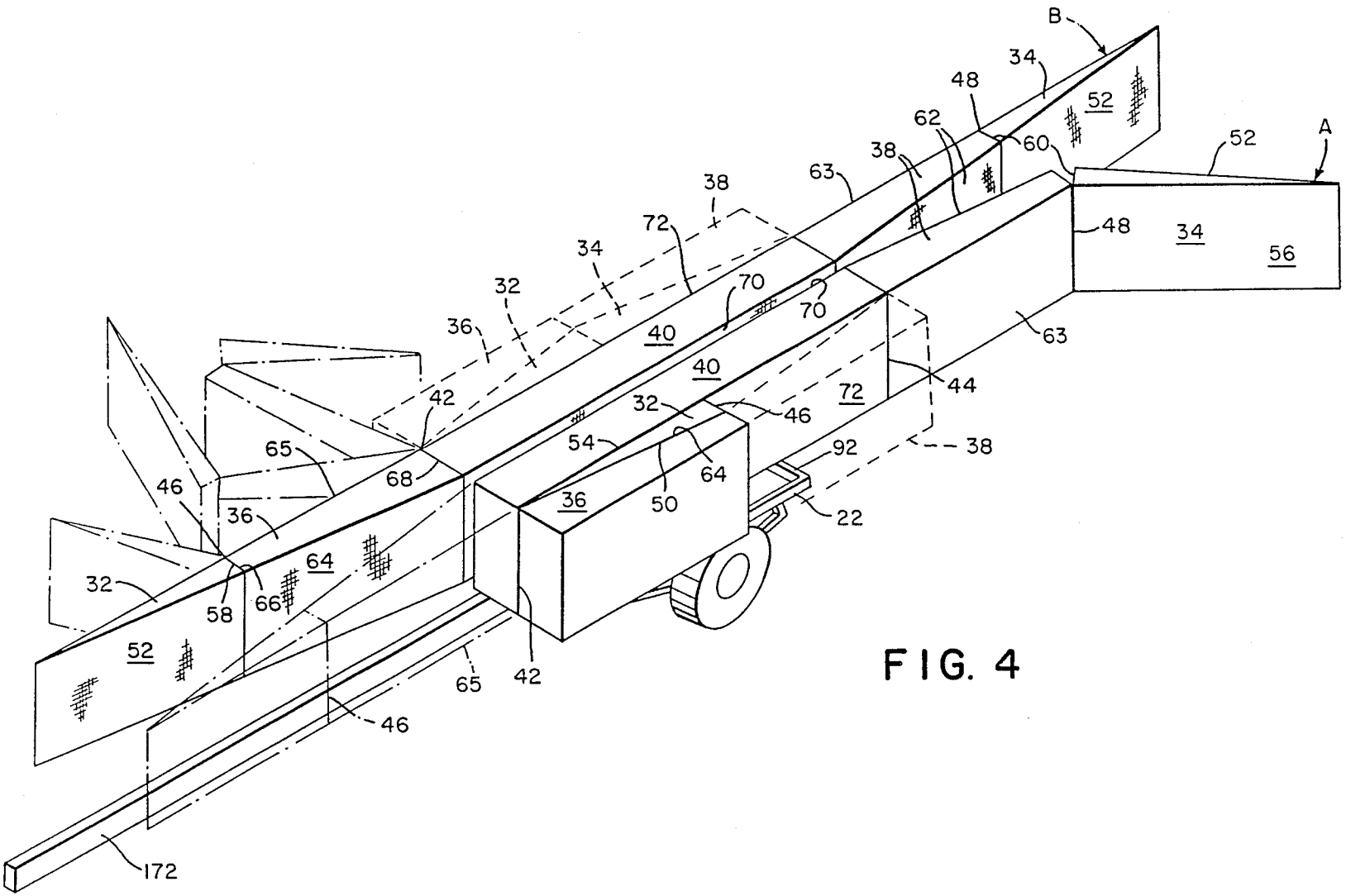
FIG. 4 is a diagrammatic, perspective view of a preferred, collapsible bridge module in accordance with the instant invention supported and mounted on the trailer, and shown with the two segmented spans in varying degrees of partially being unfolded prior to opposite rotation down into the horizontal usable condition, and wherein the dashed phantom outlines represent the collapsed and folded condition of the two span members, and the dash-dot phantom lines show additional intermediate unfolding positions.
Figure 5:
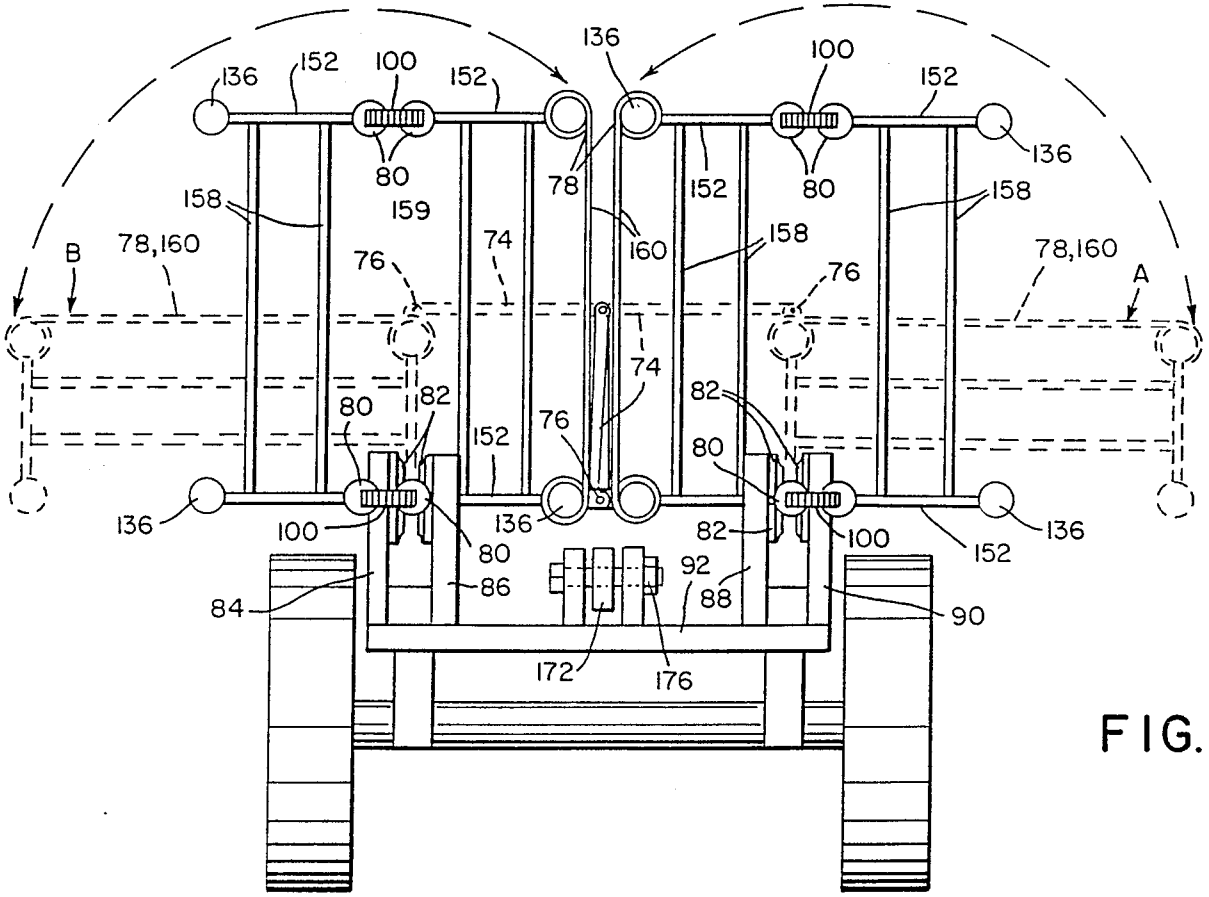
FIG. 5 is a front view of the modular bridge in accordance with the instant invention shown mounted on the trailer, with both spans shown in phantom after being pivoted down for deployment.
Figure 6:
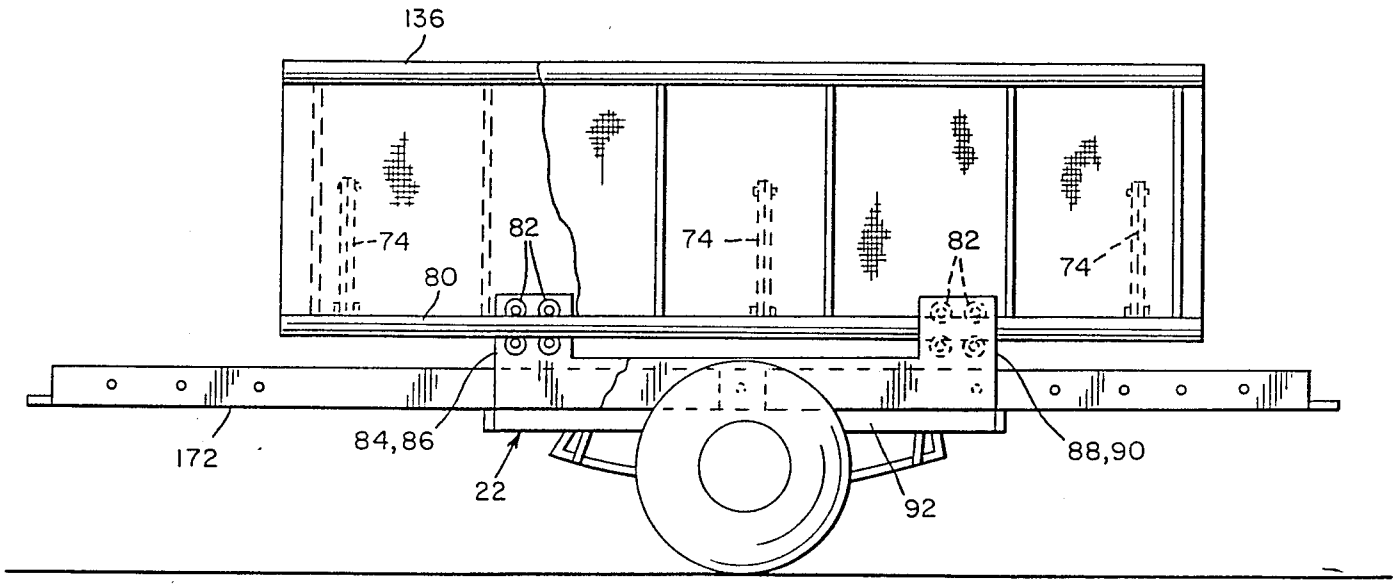
FIG. 6 is a side view of the collapsed, folded bridge module of the instant invention as shown mounted on the trailer with portions of the bridge and trailer structure broken away.

Referring now to FIGS. 4, 5 and 6, which disclose the frame structure of the modular bridge 24 more completely and which reveal the manner in which the modular bridge is coupled to the trailer, it is seen that the modular bridge is first unfolded to extend in the longitudinal direction by pivoting the gear-hinged sections of modules with respect to one another. As is seen in FIG. 4, the center bay section or central module 40 has intermediate ramp sections or modules 36 and 38 hinged thereto at lower edges 42 and 44, respectively. The intermediate ramp modules 36 and 38 have endmost ramp sections or modules 32 and 34 hinged thereto at lower edges 46 and 48. At least the endmost ramp sections or modules 32 and 34 have sloping upper surfaces 50 and 52, respectively, while lower surfaces 54 and 56 thereof lie in a plane which extends normally with respect to the end surfaces 58 and 60.

The intermediate modules 38 and 36 as shown also preferably have sloping top surfaces 62 and 64, respectively, which are complementary to the slope of endmost modules 32 and 34, to constitute intermediate ramp sections. These intermediate sections have bottom surfaces 63 and 65 which are substantially parallel to the bottom surfaces 54 and 56 of the end modules 32 and 34 and perpendicular to the ends 66 and 68 of the intermediate modules. Center modules 40 are each preferably generally rectangular in cross-section with the top surfaces 70 parallel to the bottom surfaces 72.

After the modular bridges 24 are unfolded in the manner illustrated by span A of FIG. 4 so as to extend longitudinally as shown by span B of FIG. 4, spans A and B are pivoted down as is shown in phantom in FIG. 5, with pivotally interconnected tie-rod means 74 extending between and fixed generally near or to the top edges of the spans A and B via brackets 76 to retain the spans in deployable position on the trailer 22 with the top surfaces 78 of deck component 160 of the spans extending generally horizontally.

Figure 7:
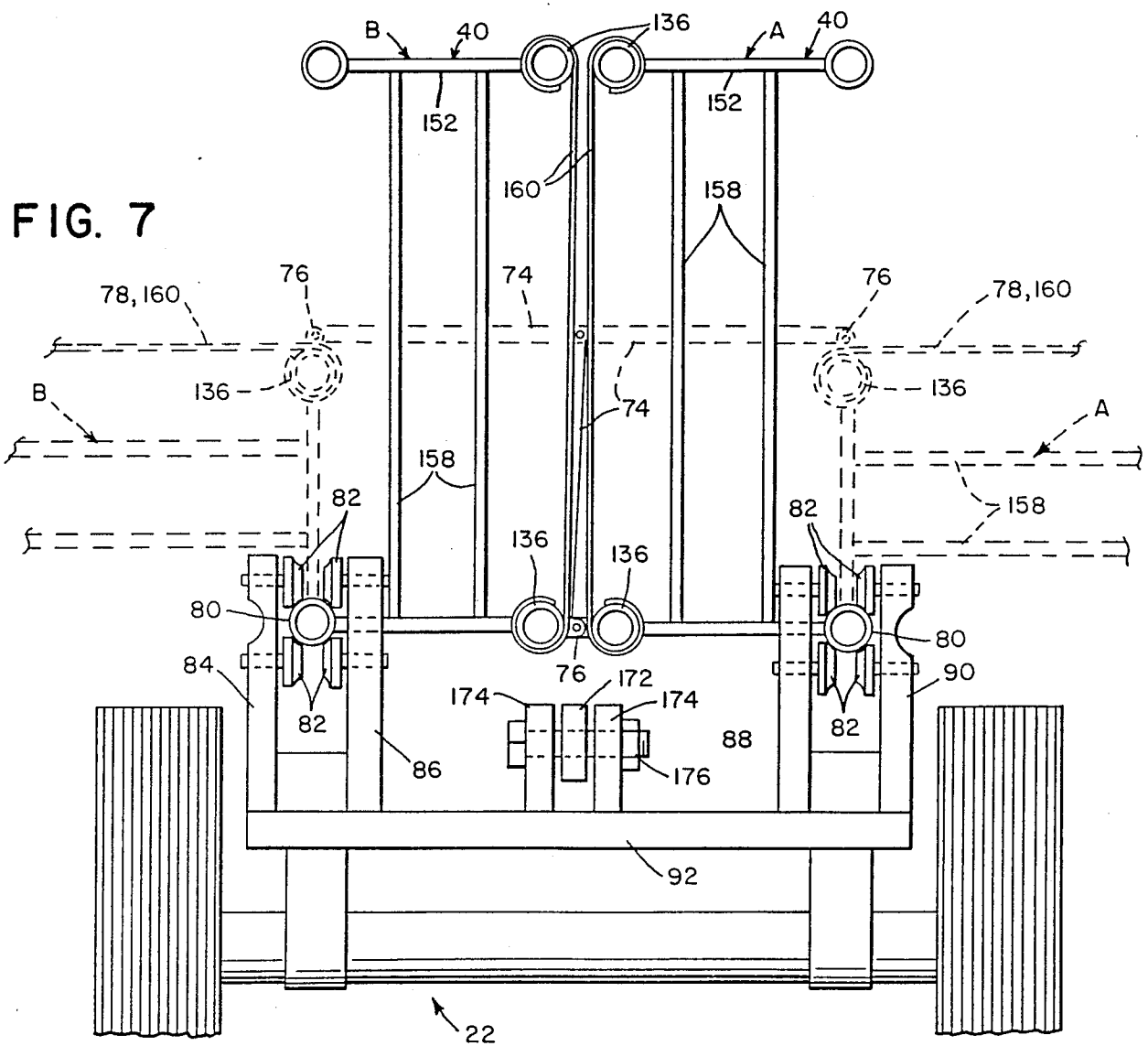
FIG. 7 is an enlarged scale end view, showing more detail and how the central module of the bridge pivots from a vertical transport position to a horizontal usable position prior to deployment.

As is seen in FIGS. 5, 6 and 7, each module of the modular bridge 24 has a lower truss chord tube 80 which is positioned inboard with respect to its span A or B and received between pairs of opposed convex-concave rollers 82 that are journaled on pairs of opposed braces 84 and 86, and 88 and 90, which are fixed to the bed 92 of the trailer 22. Upon pivoting the spans and A and B to the downward horizontal position shown in dotted lines in FIGS. 5 and 7, the modular bridge 24 can then be deployed as is shown in FIG. 2 by rolling the bridge rearwardly on the trailer 22 while being supported by the pairs of rollers 82 and then backing the trailer down into the gully 26 so that the bridge spans the gap or gully 26. In a preferred embodiment of the bridge assembly, the end module 34 which faces toward the rear of the trailer may be provided with a detachable skid or upturned flange portion 94 attachable to each span, and which skid or flange portion has a bottom surface 96 disposed at an obtuse angle to the bottom surface 56 of the module so that if the bridge happens to contact the side of the opposite bank 30, it can be pushed against the bank to ride up over the bank.

Figure 9:
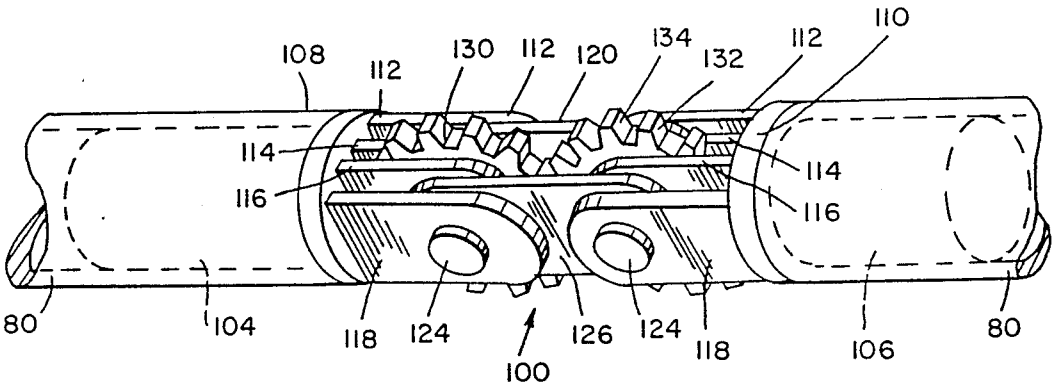
FIG. 9 is a perspective detail view of a pinned link dual-center gear hinge which pivotally connects the tubular frame of one section with another.
Figure 10:
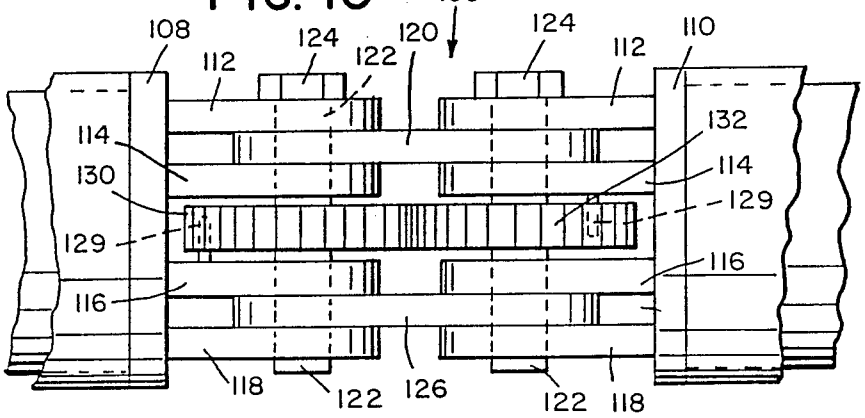
FIG. 10 is a side-elevational view of the gear hinge of FIG. 9 when the hinged-together adjacent tubular sections are in unfolded, axially aligned condition prior to being rotated downward for deployment.
Figure 8:
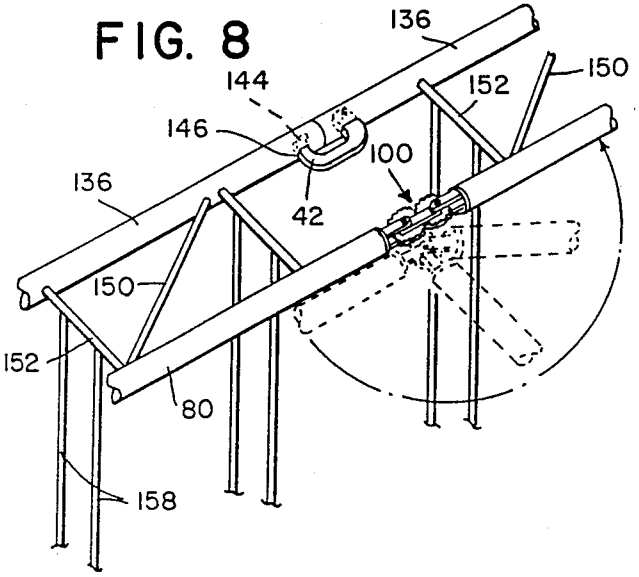
FIG. 8 is a fragmentary perspective view showing in phantom interim positions of one frame being unfolded alongside another frame and showing the frames of two adjacent deck or trackway sections of the bridge module being stabilized by the dual centered gear hinge means and latched together by the coplanar latch means so as to coextend with the other sections of the module.

Referring now more specifically to the hardware which facilitates manual deployment of the bridge, FIGS. 8, 9 and 10 illustrate a hinge, designated generally by the numeral 100, which is disposed adjacent the bottom surface of the modules at the inner and outer corners thereof that define the aforementioned hinge lines 42, 44, 46 and 48 of FIG. 4. As will be explained more completely hereinafter, each bridge module is made up of tubular truss structural elements which include the lower chord tubes 80. Each of the lower tubes 80, at the juncture of adjacent modules, includes a hinged connection to the adjacent lower tube 80 formed by the dual-centered hinge 100. The hinge 100 includes a pair of opposed clevised inserts 104 and 106, each of which is received in a lower tube 80, which inserts have base plate elements or platforms 108 and 110, respectively, that abut the ends of the lower tubes. Projecting from each of the base plate elements 108 and 110 are four spaced flanges 112, 114, 116 and 118 to form or constitute a clevis arrangement. Between clevis forming flanges 112 and 114 on both base plate elements 108 and 110 is a link 120 which is journaled on shanks 122 of pins 124 that extend completely through the array of flanges. Disposed between the other clevis forming flanges 116 and 118 on both base elements 108 and 110 is another link 126 which is also journaled on the shanks 122 of the pins 124. Between the innermost spaced flanges 114 and 116 on base element 108, there is fixed a first gear 130 which meshes with a second fixed gear 132 which is fixed between flanges 114 and 116 on base element 110. The respective gears are suitably fixed against rotation as by pins 129 extending into one or both adjacent clevis flanges. As the adjacent lower tubes 80 are pivoted one with respect to another, the dual links and enmeshed teeth 134 of the gears 130 and 132 guide and allow the lower tubes to pivot with stability as one of the gears rolls on the other.

Figure 11:
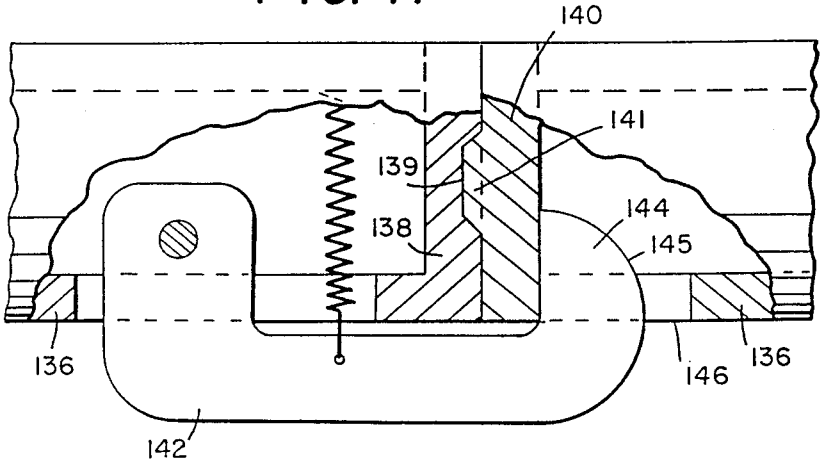
FIG. 11 is a fragmentary plan view of a latch mechanism which latches together the top truss tubes (shown partially in cross-section) of adjacent sections of the modules to one another when the modules are unfolded for deployment.

As will be explained more fully hereinafter, each module has a pair of upper, longitudinally extending truss tubes 136 which have end surfaces 138 that abut opposing end surfaces 140 of pairs of upper tubes 136 on an adjacent module. Complemental recess and boss portions 139 and 141 (FIG. 11) are preferably provided to provide more positive alignment of the adjacent chord tube members 136. As is seen in FIGS. 8 and 11, each of the upper tubes 136 is preferably detachably locked to an adjacent upper tube by a spring biased, pivoted planar hooked latch member 142 which has a head 144 with a cam surface 145 that is received in a slot 146 in the adjacent tube. As the adjacent tube latches, the latch members 142 are each disposed on the underside of the upper tubes elements 136, and the major plane of the latch members is essentially coplanar with the respective gears 130, 132.

By hinging the modules 40, 36, 38, 34 and 32 to one another adjacent their lower edges 42, 44, 46 and 48 when traffic crosses the modular bridge 24, the weight of the vehicles places the lower hinged tubes 80 in tension and the upper abutting tubes 136 in compression providing a stabilized structure for the spans A and B.

Figure 13:
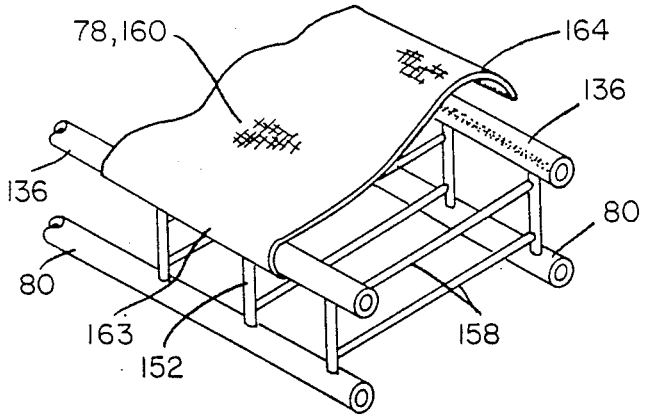
FIG. 13 is a fragmentary perspective view of a section of the module of FIG. 12.
Figure 12:
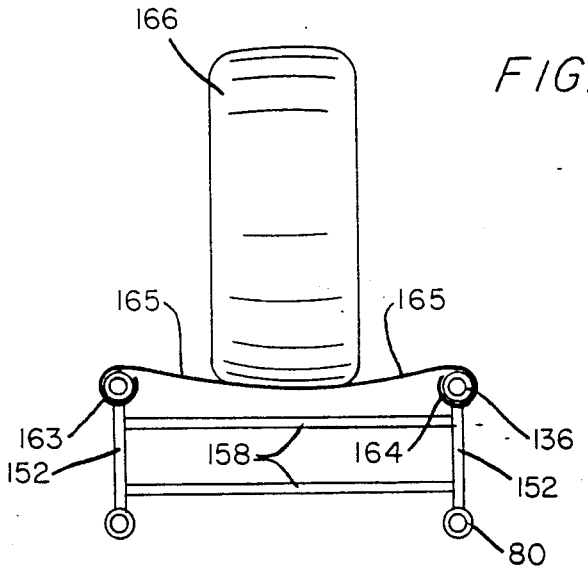
FIG. 12 is a typical semi-schematic cross-sectional or end view of a double truss section of the module showing the frame and deflected fabric deck with the tire of a vehicle thereon.

Referring now more specifically to FIGS. 12 and 13, a preferred structural configuration for each of the modules 32, 34, 36, 38 and 40 is illustrated. As is seen in FIGS. 8, 12 and 13, it is the longitudinally oriented tubes 80 and 136 that form the main truss chords. In a preferred embodiment of the invention, the truss chords are made of 3-inch diameter aluminum tubing. The truss chords formed by the tubes 80 and 136 are suitably braced by a plurality of diagonal 1-inch aluminum braces 150 (FIG. 8) and vertically extending 1 inch aluminum braces 152. Tensioned metallic cable may be used in lieu of diagonal braces 150. The truss chords formed by tubes 80 and 136 are further braced by aluminum cross members 158 to form rigid, box-like frames which support the novelly featured fabric membrane deck component 160 on each of the spans A and B, FIG. 4. The fabric membrane deck components 160, which have the aforementioned deck surfaces 78, are retained on the upper tubes 136 by a VELCRO® bond means 162 wherein looped portions of the VELCRO® material are adhesively bonded to the underside of deck 160 adjacent the side peripheries 163 and 164 thereof and the hook portions are bonded to the pairs of upper tubes 136, or vice versa. Another method to attach the fabric membrane decks 160 to the respective pairs of tubes 136 may be via rivets passing through optional clamping strips (not shown) and the fabric and into the upper tubes 136. The fabric membrane is provided with narrow reinforced edge slots to fit around the tie-rod-mounting brackets 76.

The fabric membrane deck components 160 for a preferred embodiment are made of a high strength, reinforced fabric which is stretched between the two upper chord members 136. When a vehicle rolls over the bridge 24, the tires 166 of the vehicle tension the decks 160 causing the decks to flex into a concave curve, the outboard portions 165 thereof form natural curbs preventing the vehicle wheels from driving off of the bridge 24. Alternatively, it is contemplated that more rigid decking material of semi-flexible, semi-rigid or rigid character may be used. These may include extruded wire mesh and other metallic or non-metallic composite panels.

As is seen in FIGS. 5, 7 and 14, the spans A and B of the modular bridge 24 are held together by multiple pairs of the aforesaid pivotally connected tie rod means 74 which are secured via brackets 76 to the inboard upper tubes 136 of the respective center module 40 so as to correctly space the spans A and B from one another. In the embodiment of FIGS. 5, 7 and 14, the tie rod means 74 comprises two preferably rigid struts 168 and 169 pivoted to one another at pivot 170. When the modules are in the folded collapsed condition on the support trailer, the respective center bay modules 40 are adjacently positioned very close together, being spaced slightly apart only by the engagement of the aforesaid tie-rod-attaching brackets 76 against the opposed chord member 136.

As is seen in FIG. 15, the modular bridge 24 may be deployed as a single span foot bridge.

The tow bar construction may comprise a telescoping type tow bar 23 such as shown in FIGS. 1 and 2 or simply a one-piece tow bar 172 (FIGS. 6, 7) which may be of generally rectangular section and may be removably attached to preferably plural pairs of upright trailer mounted bracket standards 174 spaced near opposite ends of trailer, with the bar being held in place with preferably a plurality of bolt, nut and/or cotter pin assemblies 176. The tow bar is also preferably storable on the trailer 22 by these same bracket and bolt means. The end of the tow bar for connecting to the tow vehicle may be of any suitable ball joint type, or the like.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

EXAMPLE

A proposed modular bridge configured in accordance with the aforedescribed structure would have two tracks or spans made up of five modules each with the heaviest central module being approximately 200 pounds. The bridge would have a span of approximately 35 feet and a width of 107 inches, so as to provide an adequate roadway for light vehicles. The entire system would weigh approximately 3,000 pounds. In the travel mode shown in FIG. 1, the module has a length of 12 feet, a width of 6 feet, 7 inches, and a height of 6 feet, 7 inches. The overall length including the tow bar is approximately 15 feet, thus spacing the front end of the unfolded modular bridge about 3 feet behind the tow vehicle.

The various modules or sections making up the modular bridge assembly are removably pivotally interconnected for ease of replacing any damaged modules, or for adding additional sections to construct different length spans.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. A collapsible, lightweight, low profile modular bridge assembly comprising modular components collectively forming a pair of foldable side-by-side vehicle-wheel-receivable spans each having a collectively formed vehicle-traversable deck component for supporting traffic, each modular component including truss type frame components supporting respective deck components and delineating a bottom area; each of said span-forming modular components including longitudinally oriented upper and lower truss chord elements and defining at least one center bay component and at least a pair of center-bay-attached oppositely inclined end ramp-component modules, said ramp component modules being one-half the length of said center bay component when in the folded condition; hinge means disposed adjacent the bottom area of the span for hinging the modules one to another in a manner such that said ramp components are adaptable to fold into collapsed adjacent compact relation to coincide with and not exceed the overall length of said center bay component, and means supporting said spans in side-by-side relation in both a first folded up condition with the deck-components in a generally face-to-face storage or travel mode, and in a deployable ready-to-use condition with the deck components unfolded in generally horizontal coplanar relation.

2. The modular bridge assembly of claim 1, wherein each modular component of the span's frame comprises a pair of parallel, interconnected, generally identical truss components embodying upper and lower longitudinally oriented pairs of truss chords; an array of laterally extending braces disposed between the pairs of upper and lower truss chords to form a tubular box span framework, and said deck component including deck forming means extending between and secured to the pair of upper truss chords, said deck forming means providing a concave cross-section when under load, thereby defining shallow channel ways or curbs which tend to inherently center and maintain wheels of lightweight vehicles during traversal of said span.

3. The modular bridge assembly of claim 1, wherein said center bay and opposite end ramp components are of modular construction with means for removably interconnecting a plurality of the respective modules in a foldable, collapsible manner to construct bridges of varying lengths, and wherein each spans' modular components are disposed on said support means so as to unfold into respectively longitudinally aligned relation with the deck components of each span facing those of the other span in an intermediate stage of deployment, and each span then being adapted to pivot about a longitudinal support axis in opposite laterally opposed side-by-side deployable relation.

4. The modular bridge assembly of claim 1, wherein said deck forming means includes a fabric membrane stretched between said two upper chord members of each modular component.

5. The modular bridge assembly of claim 2, wherein said deck forming means includes a fabric membrane stretched between said two upper chord members of each modular component and further including means for continuously securing said fabric membrane to the pairs of upper truss chords of each hingedly connected modular component.

6. The modular bridge assembly of claim 5, wherein the means for securing the fabric membrane to the upper truss chords includes two relatively connectable fastening materials secured respectively to and disposed between said fabric membrane and truss chords.

7. The modular bridge assembly of claim 2, wherein the truss chords and braces are made of high strength aluminum tubing.

8. The modular bridge assembly of claim 1, wherein each of the modules are hinged to adjacent modules by pinned dual-center dual link hinges, wherein each hinge link is pivoted by clevis means to respectively opposed lower truss chords of adjacent modules and a spur gear is nonrotatively fixed to the opposed truss chords between said dual links, said gears being meshed with one another.

9. The modular bridge assembly of claim 8, further including latch means for latching the upper truss chords to one another.

10. The modular bridge assembly of claim 1, further including a low-profile combination transport and launching or deploying trailer in combination therewith, the trailer having rollers thereon for supporting the modular bridge in both its folded and unfolded modes.

11. The modular bridge assembly of claim 10, in combination with said the trailer, wherein the trailer comprises a bed having outboard edges, the roller means being disposed in proximity with the outboard edges, the roller means compromising pairs of opposed shaped rollers, between which are received the lower truss chords of each module wherein the modules can both be rolled longitudinally with respect to the trailer for deployment of the unfolded bridge and also can pivot about the longitudinal axes of the truss chords to rotate the deck between a vertically disposed position for storage or transport and a horizontally disposed position on the trailer preparatory for deployment.

12. The modular bridge assembly of claim 11, wherein pivotally mounted and pivotally interconnected tie-rod means extends between the inboard upper truss chords of a pair of center bay component modules to define the distance the upper truss chords are laterally spaced from one another when the bridge is deployed, the lower truss chords being spaced by their continued engagement with the trailer when the trailer is suspended beneath the modular bridge.

13. The modular bridge assembly of claim 1, wherein said ramp component modules each comprise a complemental pair of hinge-connected sub-component ramp sections, and for which ramp component modules the deck component extends at an oblique angle with respect to the bottom area wherein when the span is extended the deck components are coplanar and slope toward the bottom areas with the bottom areas being coplanar and horizontal, and wherein the oblique angles of the decks are such that when sub-component ramp sections of the modules are folded one against the other in their storage mode with the bottom areas of adjacent decks of said sub-component ramp sections abutting one another, the decks of said adjacent sub-component ramp sections are parallel with each other as well as with the decks of the center bay components.

14. The modular bridge assembly of claim 13, wherein said subcomponent pair of ramp sections when in their folded storage mode are each one half the length of the center bay component and are adapted to fold into side by-side relation, wherein the ramp-component modules do not extend beyond opposite longitudinal ends of the center bay module.

15. The modular bridge assembly of claim 14, wherein each rampcomponent module including its said sub-component ramp sections, when in the folded or collapsed storage mode, has an overall thickness and collective length which is substantially equal to that of the center bay module.

16. A collapsible, lightweight bridge assembly comprising at least a pair of truss frame components with means rigidly interconnecting said frame components in laterally spaced relation to constitute a span component for spanning a gully or stream, and embodying traffic-supportable deck component means comprising tensioned at least semi-flexible membrane members, and means for replaceably attaching and detaching said membrane deck component members.

* * * * *